United States Patent [19]

Li

[11] 4,146,337

[45] Mar. 27, 1979

[54] ELECTRIC TYPEWRITER FOR MULTIPLE LANGUAGES

[76] Inventor: Alan Li, 3rd Fl., 5-3 Shao-Hsing South Rd., Taipei, Taiwan

[21] Appl. No.: 812,412

[22] Filed: Jul. 1, 1977

[51] Int. Cl.[2] ..... B41J 1/22; B41J 1/60

[52] U.S. Cl. ..... 400/143; 400/161.5

[58] Field of Search ..... 197/1 A, 55; 400/140, 400/143, 152, 160, 161, 161.1, 161.5

[56] References Cited

U.S. PATENT DOCUMENTS 2,613,795 10/1952 Yutang ..... 197/1 A 2,879,876 3/1959 Palmer et al. ..... 197/52 X

FOREIGN PATENT DOCUMENTS 1434134 5/1976 United Kingdom ..... 197/1 A

*Primary Examiner*—Paul T. Sewell

*Attorney, Agent, or Firm*—Cushman, Darby & Cushman

[57] ABSTRACT

An electric typewriter for printing indicia includes indicia-selecting and typerwriting mechanisms. Keys are associated with the indicia through a mechanical matrix which controls the positioning of a ball containing the indicia.

5 Claims, 24 Drawing Figures

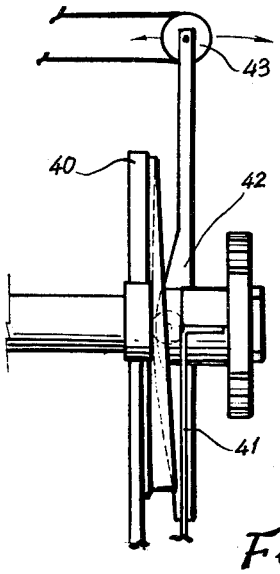
Fig. 17a
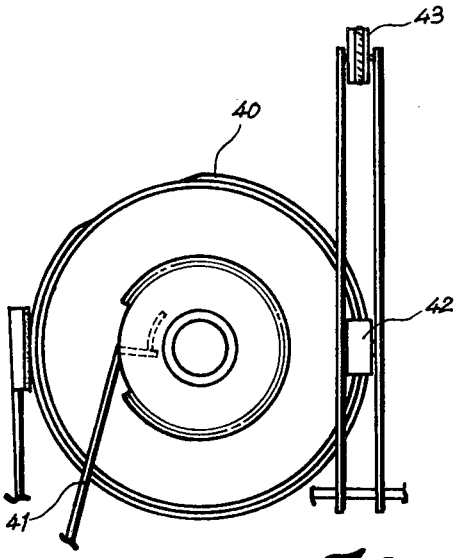
Fig. 17b
Fig. 16a
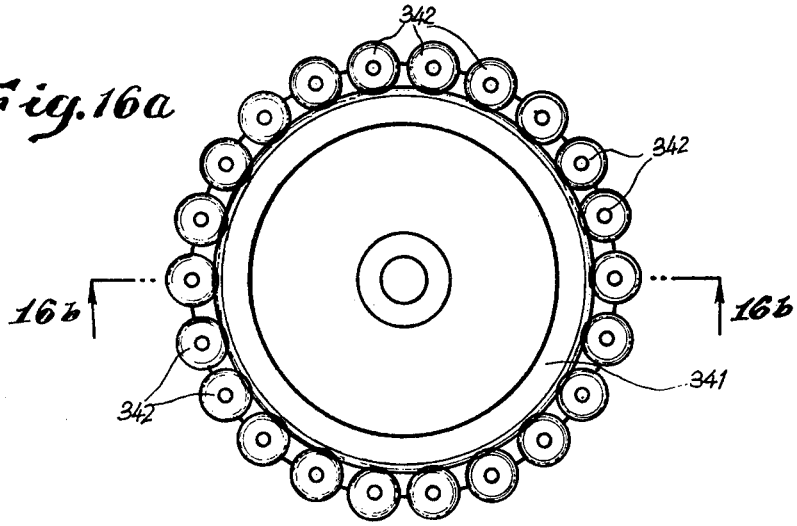
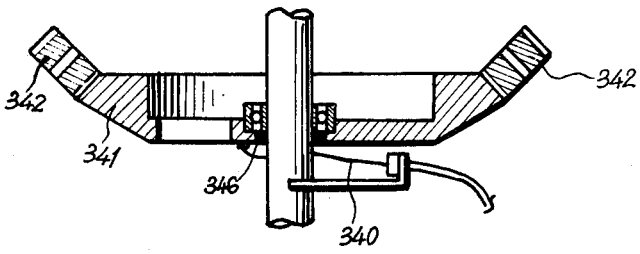
Fig. 16b

ELECTRIC TYPEWRITER FOR MULTIPLE LANGUAGES

BACKGROUND OF THE INVENTION

The conventional Chinese typewriter is actuated a lever knocking method. However, the speed of its operation can not satisfy our modern requirements. Its application is thus restricted. The present invention overcomes these restrictions. It has 2,200 letters and legends selected by keys on a keyboard. It is driven by an electric motor so as to include the advantages of electrical typewriting.

SUMMARY OF THE INVENTION

The present invention is driven by electric motor. The driving force, through driving gears, is transmitted to the word-selecting mechanism so as to form a typewriter. The word-selecting mechanism is composed of 100 word-selecting levers each having 11 keys. By pushing a key the words, the word ball is moved upwards or downwards, revolved and the small word pans on the word ball are revolved, so that the positioned indicia on the word ball can then strike the platen for typewriting.

The advantages of the present invention is shown as follows:

(A) Quick and time-saving: Pushing a key is easier than the methodology disclosed by the prior art. The typing speed will be more than 500 words per minute.

(B) Beautiful typewriting: The typing is uniform.

(C) More words:

It has words ball of spare word and rare words. The ball can be alternated during operation for incorporation of the rare or spare words. The typing speed and application range is thus facilitated.

(D) Multi-language usage:

It can be used for several languages by arrangement of words of several language on the keys.

(E) Automation:

There are six automatic keys for the automation of this typewriter. They are: space bar, shift key, back spacer, return key, variable line spacer and lining key.

(F) Development Potential:

It can be further developed for Telex typewriting or for Input/output Chinese computer application.

BRIEF DESCRIPTION OF THE DRAWINGS

FIG. 16*a* is a bottom plan view of the apparatus for rotating the small word pans in the word ball. FIG. 16*b* is a sectional view of the apparatus for rotating small work pans in the word ball taken along the 16*b*—16*b* line of FIG. 16*a*.

FIG. 17*a* is a front elevational view of pulley means for rotating the word ball 180°.

FIG. 17*b* is a side elevational view of pulley means for rotating the word ball 180°.

DESCRIPTION OF THE PREFERRED EMBODIMENT

Figure 2:
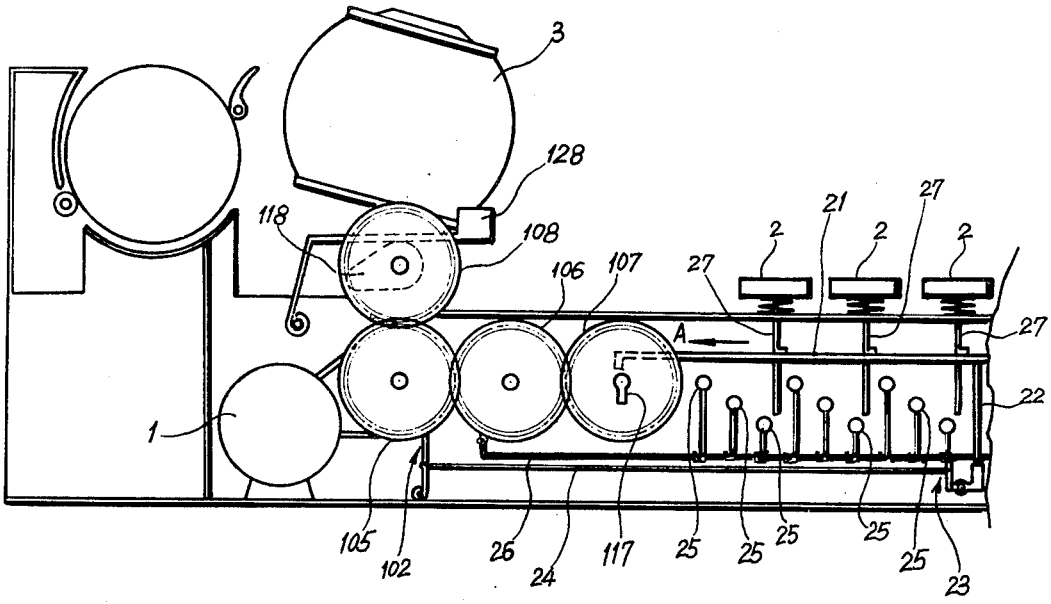
FIG. 2 is a partial sectional side-view drawing of the driving mechanism of the present invention.
Figure 3:
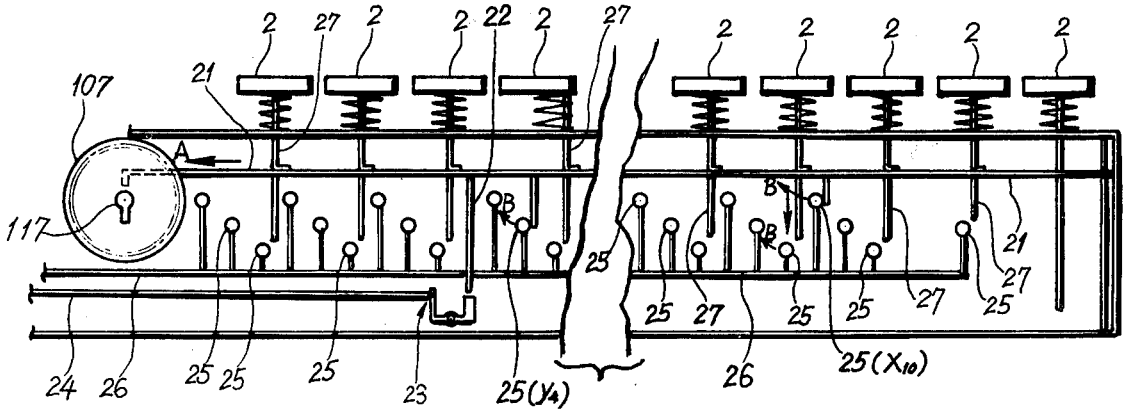
FIG. 3 is a side-view drawing of the No. 40 word-selecting lever of the present invention.

The present invention comprises 31 pendulum levers 25, word-selecting levers 21, and 1,100 keys 2. The driving force of motor 1 is transmitted through a belt to the shaft 101. Whenever a key 2 is pushed, the word-selecting lever 21 will be pressed down. Word-selecting lever 21 is connected thereunder with a control lever 22. The control lever 22 will then press down the pulling lever means 23. The pulling lever 24 will pull away the clutch 102 between shaft 101 and driving gear 105. The pin 103 will be inserted into the fly wheel 104 so as to transfer the driving force onto driving gear 105 and then respectively to word-selecting gear 106, eccentric gear 107 and typewriting gear 108. After rotating the fly wheel 104 for 306°, the clutch 102 will disengage the pin 103 and separate the driving force therefrom. In other words, the driving force is instantly transferred to each mechanism, and will be stopped after completing one action of the mechanism. (as shown if FIGS. 2, 3 & 5)

Figure 4:
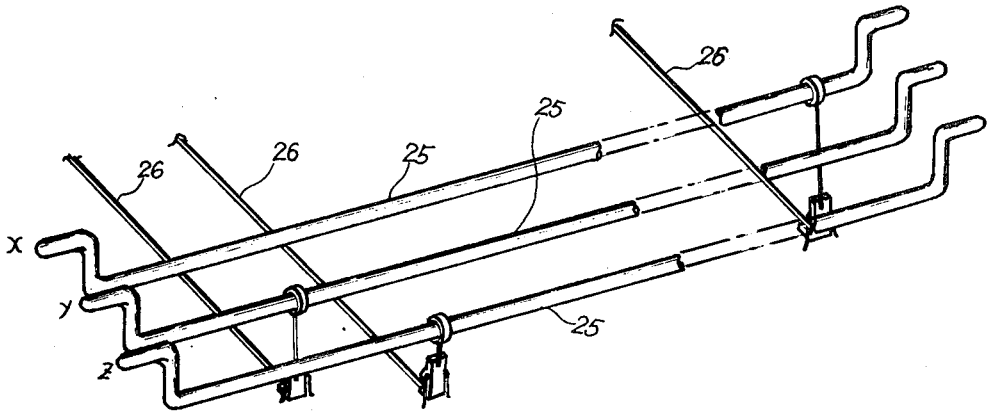
FIG. 4 is a perspective drawing of one set of pendulum levers of the present invention.

As shown in FIG. 4, the above-mentioned 31 pendulum levers 25 are organized in sets of three levers arranged equidistant. Supposing the highest is x and then y, z, and each pendulum lever 25 controls a pulling lever 26 which further control the clutch (126) of a word-selecting cam 116. However , the x levers should control one set of cams 116, while the y & z levers will each respectively control another set of cams 116 as shown in FIG. 8.

The present invention comprises 100 word-selecting levers 21 arranged perpendicularly with pendulum levers 25. Each word-selecting lever 21 has eleven keys 2. The connecting lever 27 under each key is used to trigger the z bar of each set of pendulum levers 25. The x & y bars are coordinated with the corresponding word-selecting lever 21.

Figure 8:
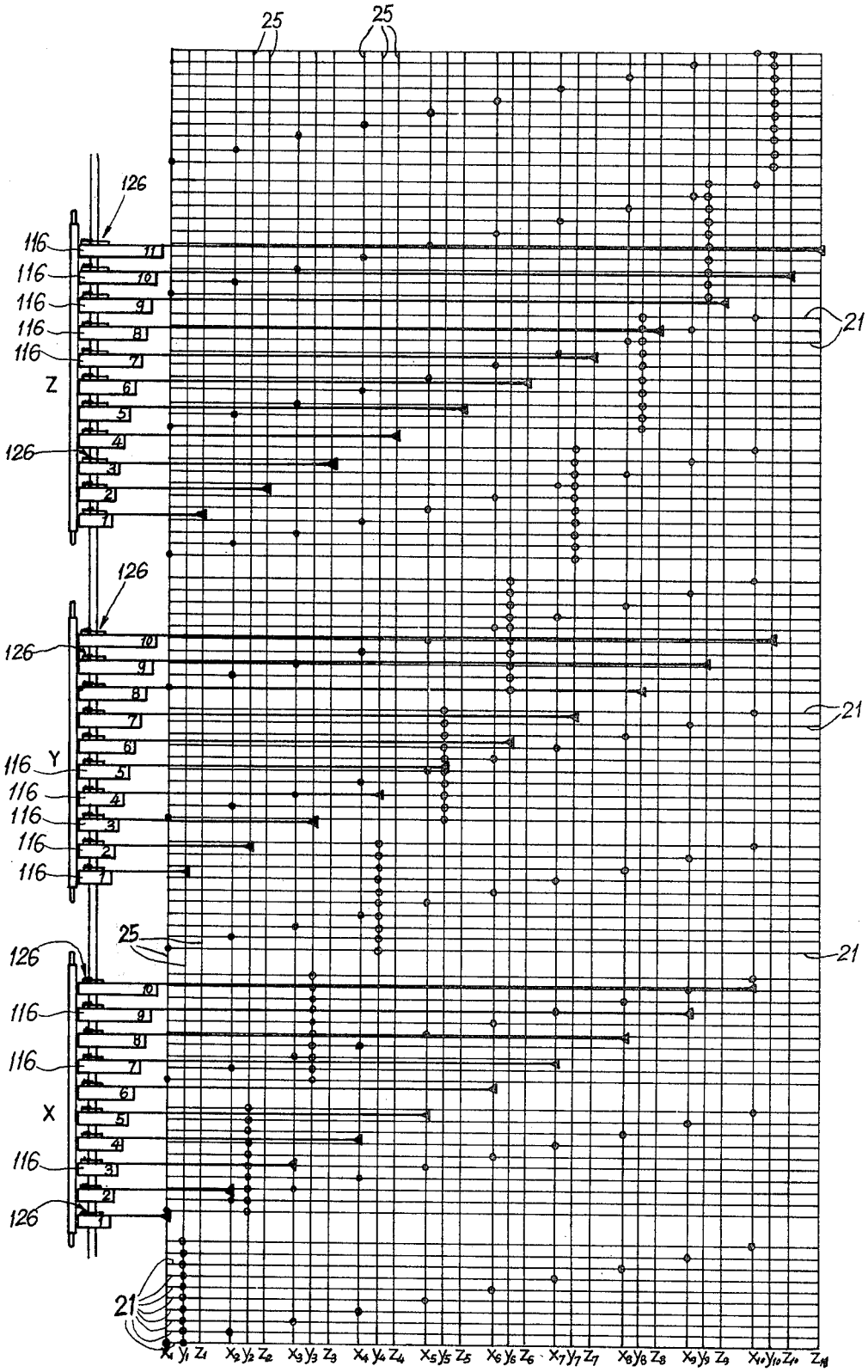
FIG. 8 is a coordination drawing of the pendulum lever corresponding with the word-selecting lever of the present invention in which mark "▲" is the coupling of the pendulum levers and word-selecting cams, "■" indicates the association of the word-selecting levers with X bar of each set of pendulum levers "O" indicates the association of the word-selecting levers with Y bars each set of pendulum will be associated with a key.

As shown in FIG. 8, mark "▲" control the clutchs 126 of word-selecting cams 116, mark "■" indicates the connection of word-selecting lever (21) with the x bars of pendulum levers 25, and "o" indicates the connection of word-selecting levers 21 with the y bars of pendulum lever 25.

Now taking No. 40 word-selecting lever 21 for discussion, upon pushing down a key 2, the word-selecting lever 21 is pressed down. The control lever 22 will then press down pulling lever means 23 so as to instantly transfer the driving force. The connecting lever 27 under key 2 will reach the right side of pendulum lever 25 (z bar). When the eccentric gear 107 is rotated, the extension of said eccentric shaft 117 will knock the bent portion at the end of word-selecting lever 21 and the word-selecting lever 21 will move in direction A. At this time, the x10, y4, z9 (FIG. 3) pendulum levers 25 will be move in direction B thrusted by word-selecting lever 21 and connecting lever 27. The pulling lever 26 will pull the clutches of No. 10 of x group word-selecting cams 116, and No. 4 of y group word-selecting cams 116 and the No. 9 of z group word-selecting cams 116. By the action of the three word-selecting cams 116, the word ball 3 will be controlled to select the desired letter or legend as indicated by key 2.

Figure 5:
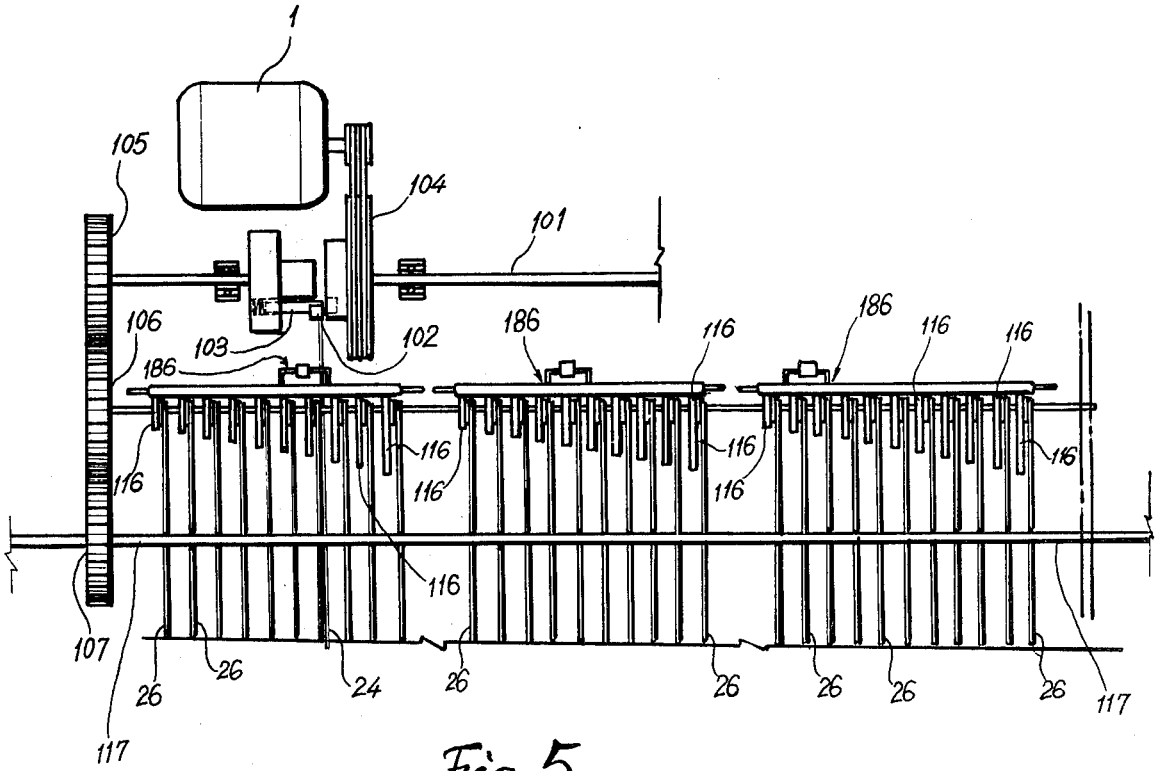
FIG. 5 is a top-view drawing of the driving mechanism and word-selecting cam set of the present invention.
Figure 6:
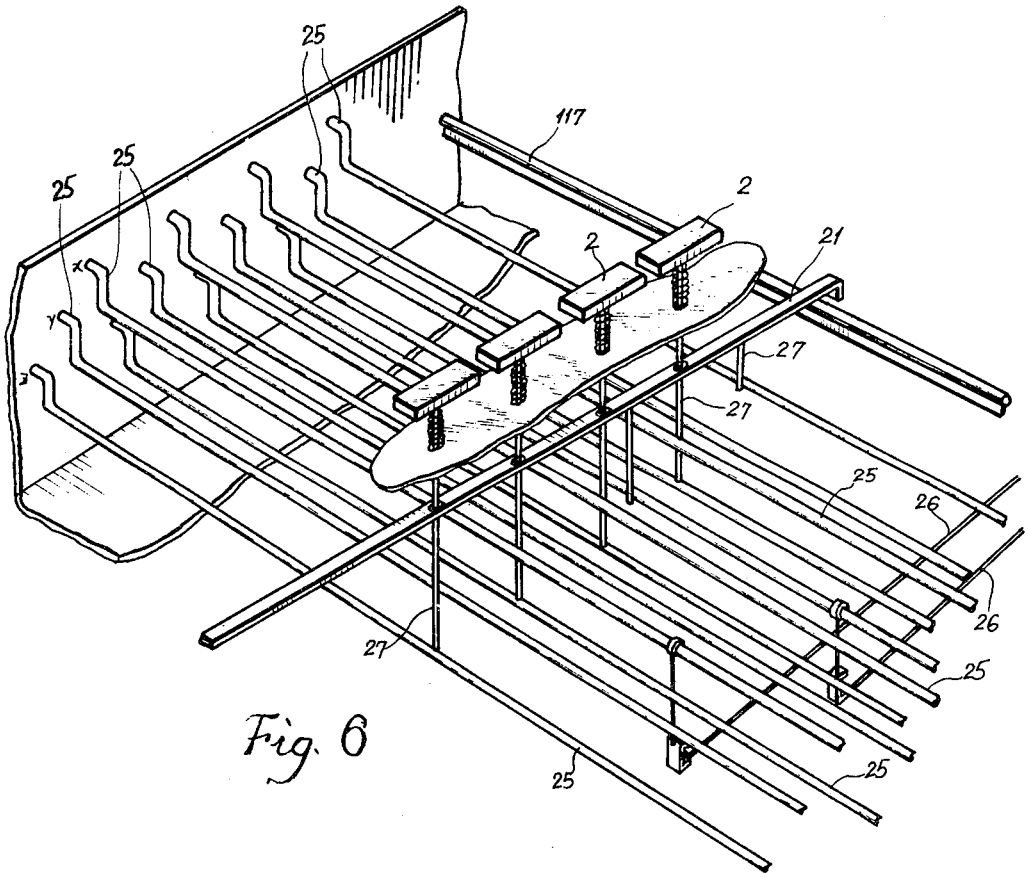
FIG. 6 is an allocation drawing of the pendulum levers and word-selecting levers of the present invention.
Figure 7:
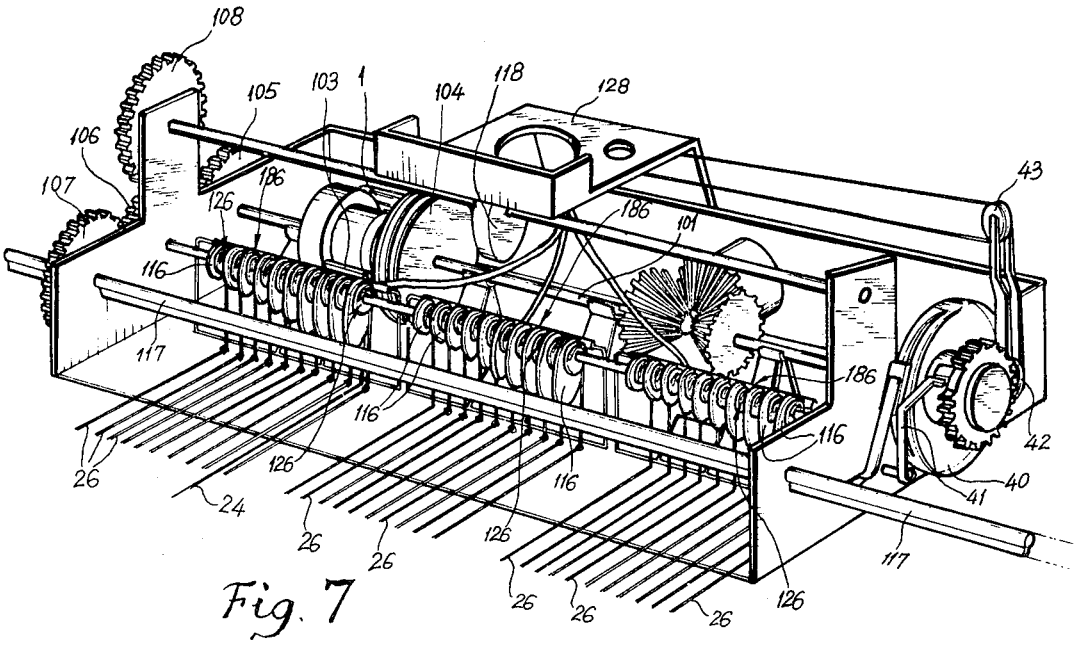
FIG. 7 is an assembly drawing of the major driving parts of the present invention.
Figure 9:
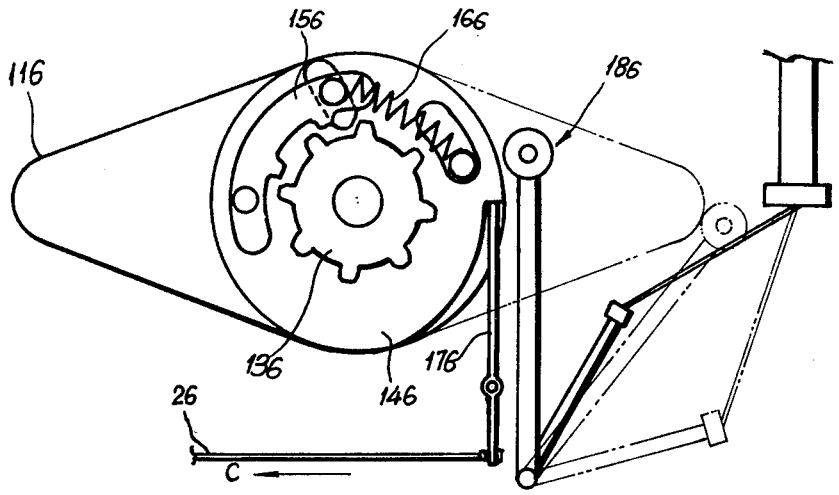
FIG. 9 is a side view drawing of the word-selecting cam with pulling means of the present invention.
Figure 10:
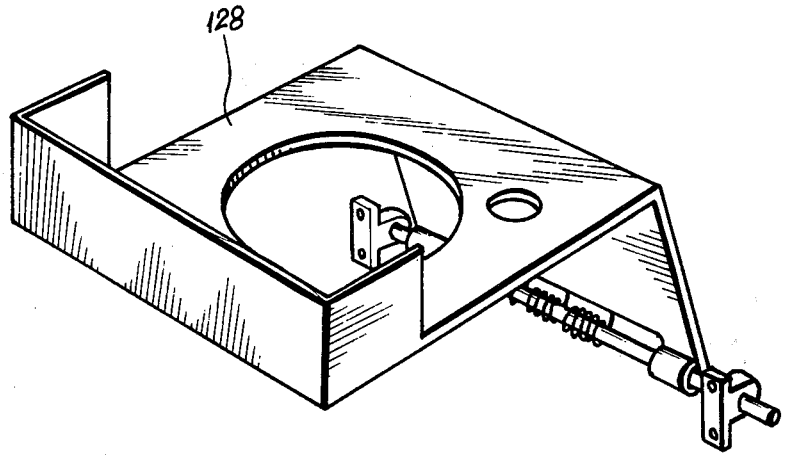
FIG. 10 is a perspective drawing of the bracket for supporting the word ball of the present invention.
Figure 11:
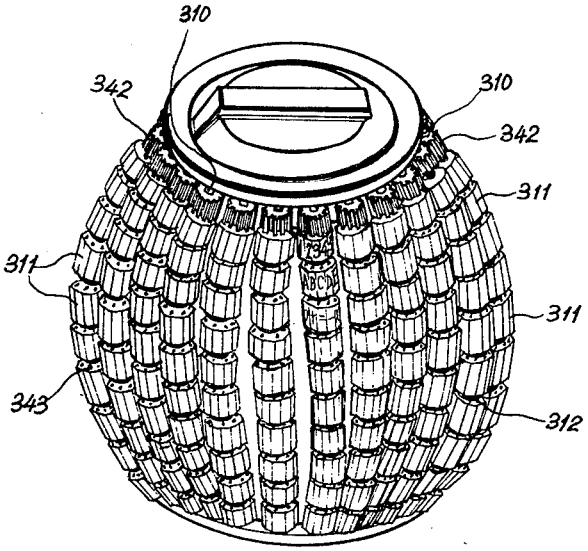
FIG. 11 is a perspective drawing of the word ball of the present invention.
Figure 12:
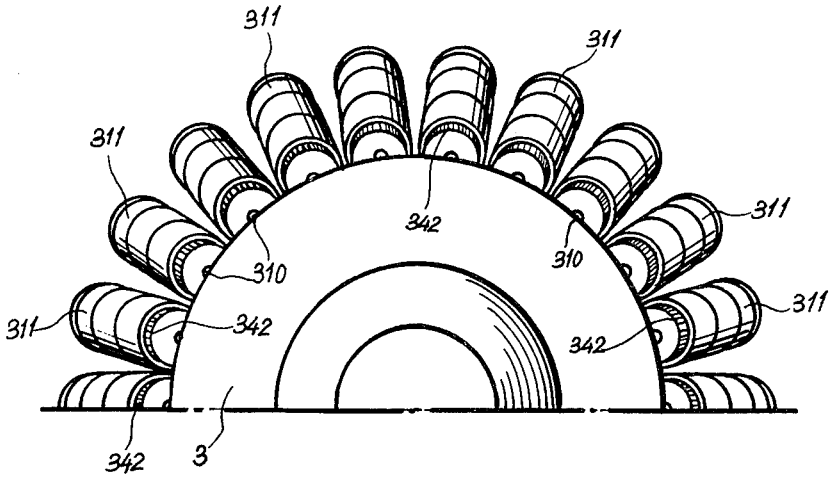
FIG. 12 is a top view drawing of the word ball.
Figure 13:
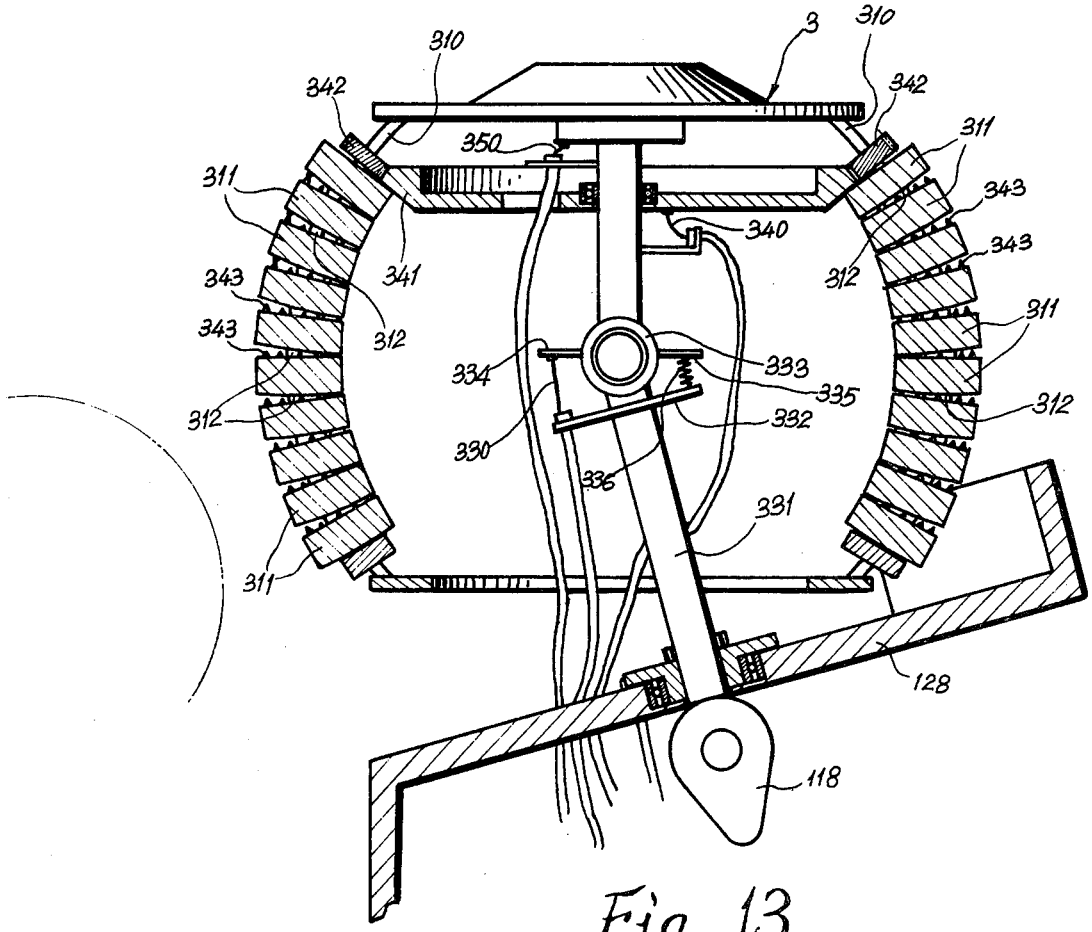
FIG. 13 is a sectional drawing of the word ball.

As shown in FIGS. 5, 7 and 9, the word-selecting cams 116 each hve a clutch 126, composed of a spur gear 136, coaxially rotated with word-selecting gear 106, the obstructing plate 146, bottom plate 156 and spring 166. The pulling lever 26, when actuated to move in direction c by pressing key 2 (See FIG. 9), pulls the obstructing lever 176, so that spring 166 will pull the button plate 156 so as to engage the spur gear 136 The driving force transferred from word-selecting gear 106 will reach the obstructing plate 146 and word-selecting cam 116 to push the pulling means 186.

The moving distance of said pulling means 186 pushed by cam 116 will control the word selection of word ball 3.

For each key pressed, only three word-selecting cams 116 will be actuated. One each from x, y or z group word selecting cams 116 will be coupled with word-selecting gear 106. The remaining 28 word-selecting cams 116 are not driven and will not be actuated.

As shown in FIGS. 11,12,13,18*a*, 18*b* & 19, the word ball 3 is essentially composed of 22 shafts 310, the small gear 342 jacketed thereon, small word pans 311 and tilting packing rings 312. Each shaft 310 comprises ten small word pans 311. Each small word pan 311 is decagon with ten letters or legends. Thus each word ball 3 has a total of 220 small word pans 311 and 2200 letters (or legends). Consider FIG. 13.

(A) As shown in the figure steel wire 330 is routed through a hose attached to fixing pan 332 of fixing shaft 331 attached to word ball 3. One end of steel wire 330 is fixed on the pulling means 186 behind the x group word-selecting cams 116 (See FIGS. 5 & 9). The other end of the steel wire 330 is attached underneath the extending arm 334 of rotating yoke 333. Another extending arm 335 opposite to extending arm 334 is fastened to fixing pan 332 by a spring 336.

When any word-selecting cam 116 in the x group word-selecting cams pushes away the pulling means 186 upon the striking of a key 2 steel wire 330 will pull down the extending arm 334 so as to rotate the integrating word ball 3 downwards to a specific angle. When wire 330 is released, the spring 336 will pull the word ball 3 to its original position.

Figure 19:
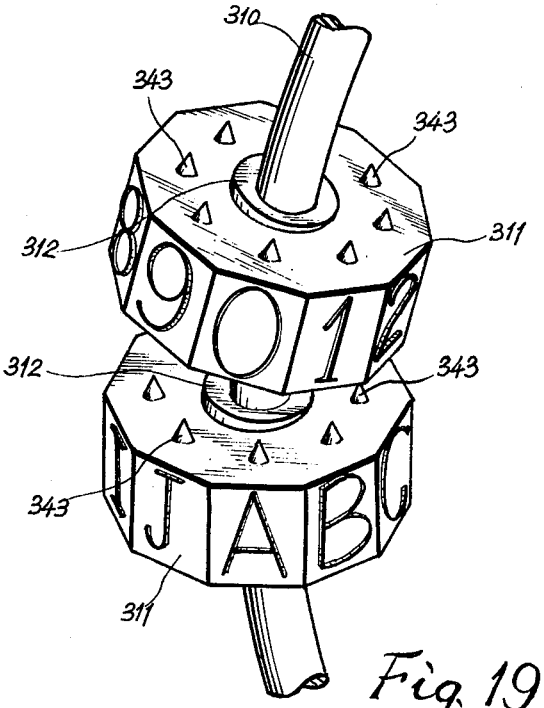
FIG. 19 is a drawing of the small word pan located on a shaft of the word ball and also of the tilting packing ring thereon.
Figure 20:
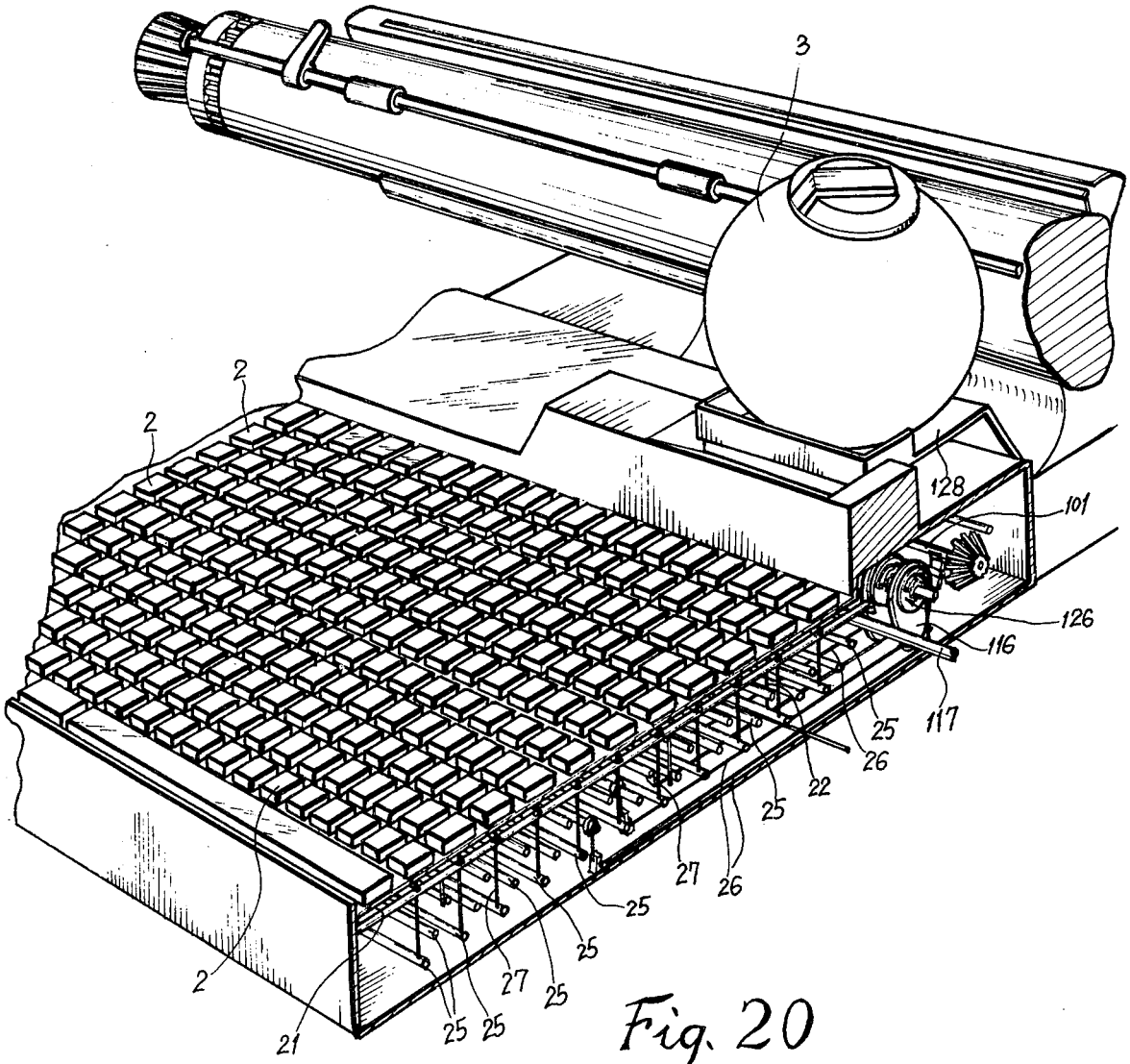
FIG. 20 is a partial perspective drawing of the present invention.
Figure 21:
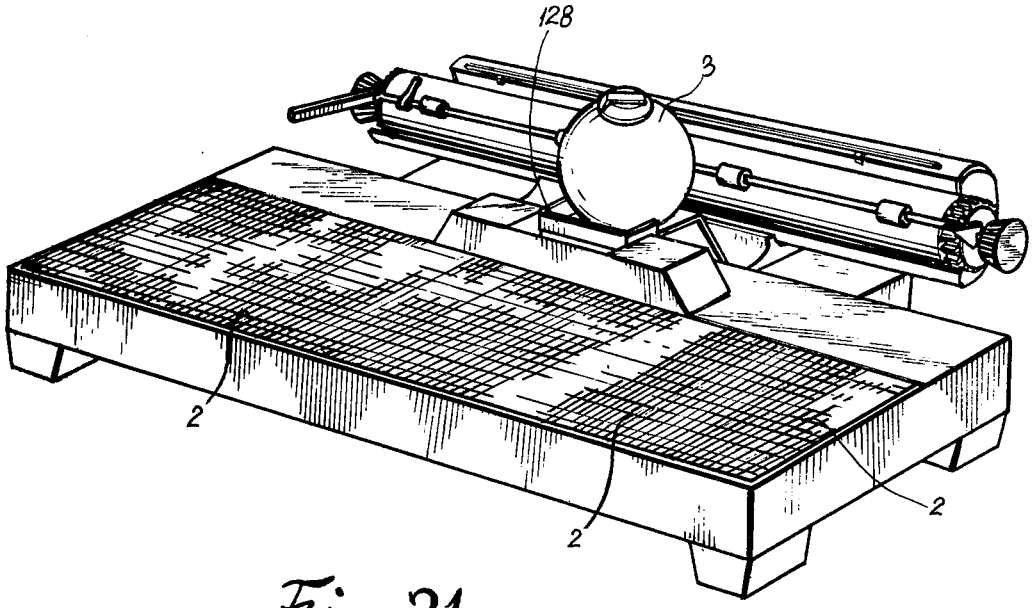
FIG. 21 is a perspective drawing of the present invention.

(B) The steel wire 340 is used to control the rotation of small word pans 311 on shafts 310 of word ball 3 which is controlled by the y group word-selecting cams. When the driving force is transferred through word-selecting cam 116 and reaches steel wire 340, the bevelgear 341 (see FIGS. 16*a* and 16*b*) is rotated when pulled by steel wire 340. The twenty two small gears 342 on top of shafts 310 are coupled as follows. As shown in FIGS. 16*a*, 16*b* & 19, the small word pans 311, jacketed on the shafts 310 have one face provided with eight cones 343, and another face inclined to the edges provided with eight cone holes 344 (see FIGS. 18*a* and 18*b*). Tilting packing rings 312 are inserted between said small word pans 31 so that, when the word pans are rotated by small gear 342, their side face will be aligned with the center of word ball 3. When the steel wire 340 is not tensioned, the bevel gear 341 will be actuated by the helical inner spring 346 and be returned to its original position.

Figure 14:
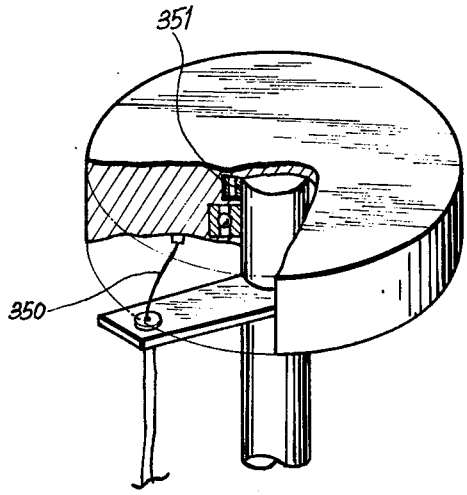
FIG. 14 is the mechanism for rotating the word ball.
Figure 15:
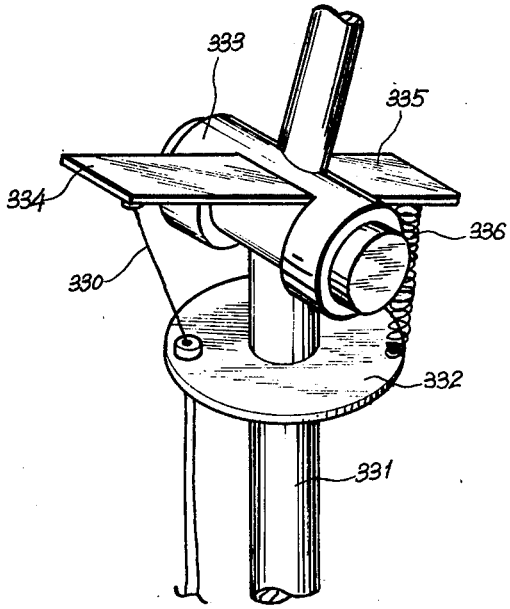
FIG. 15 is the mechanism for rotating word ball upward or downward.
Figure 18A:
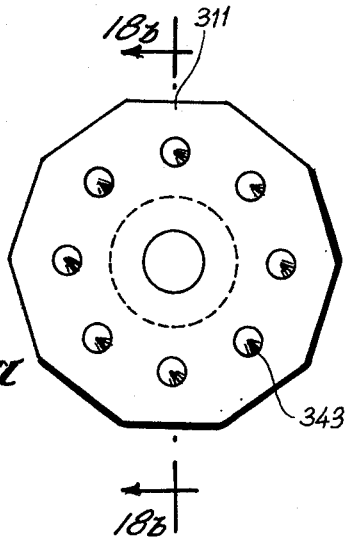
FIG. 18*a* is a top plan view of the small word pans.
Figure 18B:
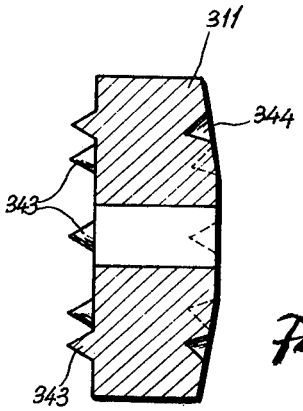
FIG. 18*b* is a sectional view taken along the 18*b*—18*b* line of FIG. 18*a*.

(C) Another steel wire 350 is used to control the rotation of the integrated body of word ball 3. As shown in FIG. 14, the degree of rotation and therefore the word selection is controlled by the eleven word-selecting cams 116 of z group. When the steel wire 350 is relaxed, the word ball 3 will be returned to its original position by the worm helical spring 351.

When typewriting is performed by using the word ball 3, only half of the ball is rotated for typewriting. The other half of the ball, containing 1100 words, can be used for typewriting when the shift is pushed. The obstructing lever 41 will be retracted (as shown in FIG. 7), the inner spring of the special cam 40 is compressed, 17*a* and 17*b* and the cam is turned by the driving gear 105. Roller follower 42 will be pushed away so that its upper pulling roller 43 will rotate the fixing shaft 331 (See FIG. 13) of word ball 3 180 degrees permitting the other half of the word ball 3 be used. After the special cam 40 rotates the full 306 degrees, the obstructing lever 41 will obstruct the cam and extend the inner spring, thus stopped the special cam 40, so that the word ball 3 will be rotated back to its original position.

Figure 1:
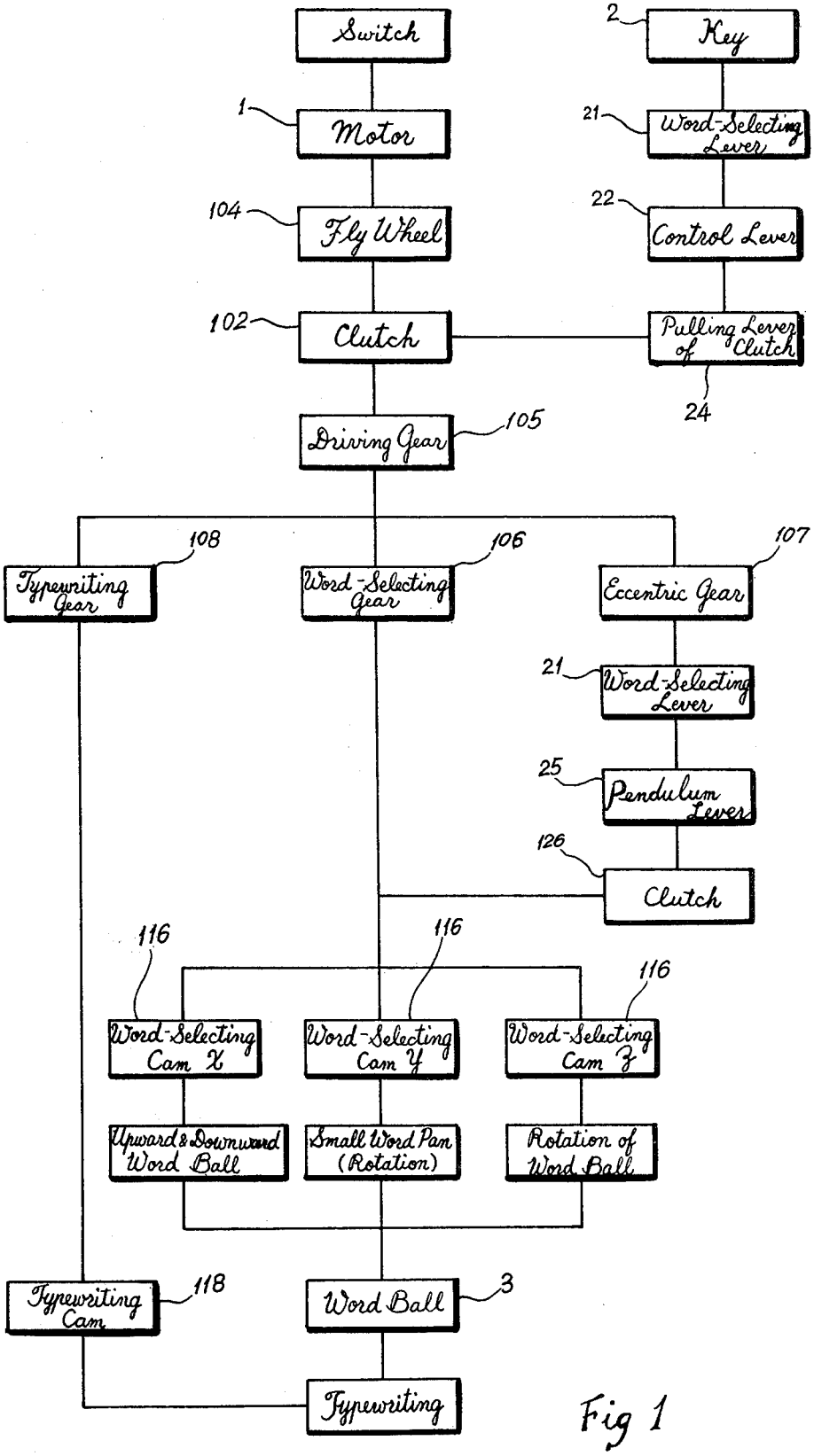
FIG. 1 is a drawing showing the principle and procedure of the typewriter in accordance with the present invention.

Upon pushing any one of the 1100 keys 2 as shown in FIG. 1, word-selecting lever 21, control lever 22, control clutch 102, will be actuated, turning driving gear 105. This will cause typewriting gear 108, word-selecting gear 106, and eccentric gear 107 to turn. The eccentric shaft 117 on gear 107 will be actuated to pull the word-selecting lever 21 carrying the pendulum levers 25 to activate the clutches 126 (one each from the x, y & z groups) so as to transfer the driving force of word-selecting gear 106 into the appropiate word-selecting cams 116. The selected cams 116, through pulling means 186, control the movement of word ball 3 thereby selecting the word or symbol and placing it in the appropriate position to be typed. The force from type-writing gear 108, through the coaxial large cam 118, will push the bracket 128 of word ball so that the word ball will hit the platen for typewriting or printing. Every action will be finished when the driving gear 105 has rotated 360 degrees. After rotating the driving gear 105 has rotated 360 degrees, the clutch 102 will uncouple gear 105 from the fly wheel 104, so that the driving force is then stopped.

I claim:

1. An electric typewriter for printing indicia comprising:

a ball having a plurality of indicia formed at different locations on the surface thereof;

ball mounting means for moving said indicia on said ball in three degrees of freedom to a position presenting one of said indicia for printing;

means for urging movement of said ball to a reference position;

a plurality of manually operable keys each associated with at least one of said indicia for causing that indicia to be printed when the key is operated;

means for mounting said keys in an array of columns and rows;

a plurality of first levers each extending below one of the columns, said first levers moving vertically when one of the keys of that column is operated to engage that first lever, said first lever having first and second projections indicating the column;

a plurality of x, y & z pendulum levers mounted below said keys, one said z lever engaging with any one of said keys in one of said rows when said any one of said keys is manually operated, a unique pair of one of each said x and y levers being engaged by said projections for movement with each of said first levers when any one of said first levers moves vertically;

means for engaging a first lever to cause horizontal movement of said first lever and the coupled x, y & z pendulum levers levers when a key and said first lever are depressed; and means for moving said ball to a position presenting the indicia on the operated key in response to said horizontal movement of said coupled x, y & z pendulum levers.

2. An electric typewriter according to claim 1 wherein said means for moving the ball comprises:

a plurality of x, y & z cams associated with said plurality of x, y & z pendulum levers;

an eccentric shaft through said cams;

means for connecting said cams to said eccentric shaft when said associated x, y & z pendulum levers are moved horizontally; p1 means for driving said eccentric shaft;

three pulling means, one each riding on x cams, y cams and z cams;

steel wires linking said pulling means and said ball; and means for controlling the position of said ball relative to the position of said steel wires.

3. An electric typewriter according to claim 1 further comprising:

a platen;

a typewriting gear;

means for driving said typewriter gear;

a typewriting cam connected to said typewriting gear for movement therewith;

a ball bracket mounting said ball and riding said cam for movement by said cam; and said platen being struck with said indicia of the operated key upon movement of said ball bracket by said cam.

4. An electric typewriter according to claim 2 wherein said ball comprises:

a rotation yoke controlled by one of said steel wires connected to said pulling means riding on x cams, for rotating said ball upward and downward;

a plurality of shafts extending vertically along the surface of said ball;

a plurality of type pans located on said shafts for rotation thereabout each said type pan having a plurality of faces with the indicia to be typed so that rotation of a pan presents said indicia;

a plurality of small gears each located at the top of one of said shafts for rotating that shaft;

a bevel gear means connected to said bevel gear, controlled by a steel wire connected to said pulling means riding on said y cams; and means for rotating said ball controlled by a steel wire connected to said pulling means riding on said z cams.

5. An electric typewriter for printing indicia according to claim 4 wherein the means for urging movement of said ball to a reference position comprises:

a spring on said bevel gear supplying a force contrary to said steel wire connected to said y cams;

a spring on said ball supplying a force contrary to said steel wire connected to said z cams; and a spring connected to said rotation yoke, supplying a force contrary to said steel wire connected to said x cams.

* * * * *